US009784107B2

(12) United States Patent
Gilbert

(10) Patent No.: US 9,784,107 B2
(45) Date of Patent: Oct. 10, 2017

(54) HYDRAULIC MOTOR

(71) Applicant: Parker-Hannifin Corporation, Cleveland, OH (US)

(72) Inventor: Kenneth T. Gilbert, Bristol, TN (US)

(73) Assignee: PARKER-HANNIFIN CORPORATION, Cleveland, OH (US)

( * ) Notice: Subject to any disclaimer, the term of this patent is extended or adjusted under 35 U.S.C. 154(b) by 0 days.

(21) Appl. No.: 14/060,363

(22) Filed: Oct. 22, 2013

(65) Prior Publication Data

US 2014/0112813 A1 Apr. 24, 2014

Related U.S. Application Data

(60) Provisional application No. 61/716,873, filed on Oct. 22, 2012.

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/00*** | (2006.01) |
| ***F01C 1/10*** | (2006.01) |
| ***F01C 21/10*** | (2006.01) |
| ***F04C 2/10*** | (2006.01) |
| ***F04C 2/08*** | (2006.01) |

(Continued)

(52) U.S. Cl.

CPC ..... *F01C 1/10* (2013.01); *F01C 21/108* (2013.01); *F03C 2/08* (2013.01); *F04C 2/086* (2013.01); *F04C 2/10* (2013.01); *F04C 2/103* (2013.01); *F04C 2/105* (2013.01); *F04C 15/06* (2013.01)

(58) Field of Classification Search

CPC ..... F04C 2/103; F04C 2/104; F04C 2/105; F04C 2/10; F04C 2/086; F04C 2/3446; F04C 15/06; F01C 1/10; F01C 1/104; F01C 21/108; F03C 2/08

USPC ..... 418/61.3, 186–188, 1

See application file for complete search history.

(56) References Cited

U.S. PATENT DOCUMENTS 3,490,383 A * 1/1970 Parrett ..... F04C 2/103 418/61.3

3,846,051 A * 11/1974 McDermott ..... F04C 2/103 418/61.3

(Continued)

FOREIGN PATENT DOCUMENTS

EP 2 497 951 A1 9/2012

*Primary Examiner* — Theresa Trieu

(74) *Attorney, Agent, or Firm* — Renner, Otto, Biosselle & Sklar, LLP

(57) ABSTRACT

A hydraulic geroller (gerotor) motor, wherein an inner rotor of a revolving group has a plurality of lobes circumferentially spaced along an outer periphery of the inner rotor, and an orbiter of the revolving group includes an orbiting ring and rounded vane portions preferably formed by roller vanes contained in inner recesses of the orbiting ring for common orbiting with the orbiting ring about the fixed longitudinal axis. The orbiter also has fixed for orbiting therewith, fluid windows for directing fluid from the fluid ports to the revolving group. The windows may be formed in an integral portion of the orbiter or in a valve plate mounted for common orbiting with the orbiting orbiter. The valve plate cooperates with a stationary commutator plate or assembly to provide an efficient arrangement for the delivery and exhaust of hydraulic pressure fluid to and from the hydraulic motor.

19 Claims, 16 Drawing Sheets

(51) Int. Cl.
*F03C 2/08* (2006.01)
*F04C 15/06* (2006.01)

(56) References Cited

U.S. PATENT DOCUMENTS

| | | | | |
|---|---|---|---|---|
| 3,862,814 | A * | 1/1975 | Swedberg | 418/61.3 |
| 3,894,821 | A | 7/1975 | White, Jr. | |
| 4,563,136 | A | 1/1986 | Gervais et al. | |
| 4,824,347 | A * | 4/1989 | Dlugokecki | 418/61.3 |
| 6,074,188 | A | 6/2000 | White | |
| 6,783,339 | B2 | 8/2004 | Dong et al. | |
| 6,832,903 | B2 * | 12/2004 | Petersen et al. | 418/61.3 |
| 6,932,587 | B2 | 8/2005 | Dong | |
| 7,431,635 | B2 | 10/2008 | Dong et al. | |

* cited by examiner

HYDRAULIC MOTOR

RELATED APPLICATIONS

This application claims the benefit of U.S. Provisional Application No. 61/716,873 filed Oct. 22, 2012, which is hereby incorporated herein by reference.

FIELD OF INVENTION

The present invention relates generally to hydraulic motors, and more particularly to hydraulic motors having a rotating rotor and an orbiting ring and roller vanes.

BACKGROUND

Hydraulic systems include engines, hydraulic pumps, and hydraulic motors, and are used for consumer and commercial products, industrial processes, and systems for vehicles. One example of a hydraulic motor, used for example in the drive system of zero-turn-radius mowers, is a geroller motor. A geroller motor may be driven, for example, by a variable displacement piston pump to provide rotary motion for rotating a mower drive wheel.

Geroller motors typically have one of two types of shafts. A geroller motor having a flexible shaft that wobbles, such as a splined "dog-bone" shaft, typically has one moving member, such as an inner rotor, that both rotates and orbits with respect to a central longitudinal axis extending longitudinally through the geroller motor. Alternatively, a geroller motor having a straight-through shaft supported by bearings on both ends often includes two revolving members, an outer ring and an inner rotor. The outer ring is disposed about and interengages with the inner rotor. The members are received within a locating ring or casing. Movement of the members with respect to one another, and with respect to the casing, allows for full stationary contact between the shaft and the inner rotor. This contact allows the shaft to be extended through the hydraulic motor for mounting auxiliary devices, such as parking brakes, auxiliary drive functions, or encoders for speed readout or closed loop control.

Straight-through shaft geroller motors often operate at high temperatures and pressures where structural integrity is an important factor. The arrangement of the members and straight shaft allows for low internal pressure drop, high mechanical efficiency, high flow capability, and high torque output.

SUMMARY OF INVENTION

The present invention provides a hydraulic geroller (aka gerotor) motor, wherein an inner rotor of a revolving group has a plurality of lobes circumferentially spaced along an outer periphery of the inner rotor, and an orbiter of the revolving group includes an orbiting ring and rounded vane portions preferably formed by roller vanes contained in inner recesses of the orbiting ring for common orbiting with the orbiting ring about the fixed longitudinal axis. The orbiter also has fixed for orbiting therewith, fluid windows for directing fluid from the fluid ports to the revolving group. The windows may be formed in an integral portion of the orbiter or in a valve plate mounted for common orbiting with the orbiting orbiter. The valve plate cooperates with a stationary commutator plate or assembly to provide an efficient arrangement for the delivery and exhaust of hydraulic pressure fluid to and from the hydraulic motor.

According to one aspect of the invention, provided is a hydraulic motor including a motor housing having a fluid inlet and a fluid outlet, an output shaft mounted within the motor housing for rotation about a fixed longitudinal axis, and a revolving group for revolving in respect to the fixed longitudinal axis. The revolving group includes an inner rotor mounted on the output shaft, the inner rotor having a plurality of lobes circumferentially spaced along an outer periphery of the inner rotor, an orbiting ring surrounding the inner rotor, the orbiting ring having a plurality of inner recesses circumferentially spaced along an inner periphery of the orbiting ring, and a plurality of roller vanes disposed between the inner rotor and the orbiting ring, the roller vanes being received in the inner recesses for common orbiting with the orbiting ring about the longitudinal fixed axis. The orbiting ring and roller vanes orbit about the inner rotor and in respect to the fixed longitudinal axis.

The hydraulic motor may further include a valve plate integral with the orbiting ring, the valve plate having a plurality of fluid windows for enabling fluid communication between the fluid inlet and outlet and the revolving group. The hydraulic motor may further include a commutator assembly coupled to the motor housing, the commutator assembly including a plurality of commutator plates each having a plurality of apertures forming inlet and outlet ports for enabling fluid communication between the fluid inlet and outlet and the valve plate.

The lobes and the roller vanes may interengage to define a plurality of expanding and contracting volume chambers where rotation of the inner rotor may cause the volume chambers to change volume. The hydraulic motor may also include a commutator plate mounted to the housing, the commutator plate in fluid communication with the fluid inlet and outlet, and a valve plate configured to orbit with the orbiting ring, where the valve plate includes fluid windows that align with the inlet and outlet ports in the commutator plate to cause the volume chambers to expand and contract.

The inner rotor may have an internal bore having a plurality of rotor splines configured to engage shaft splines on the output shaft. The orbiting ring may have a plurality of outer recesses circumferentially spaced along an outer periphery of the orbiting ring. Each outer recess may interengage with a radially-extending protrusion spaced circumferentially about an inner periphery of the motor housing to constrain the orbiting ring from rotating. The radially-extending protrusion may be a motor bolt extending into the motor housing and located between an inner periphery of the motor housing and the outer periphery of the orbiting ring.

The inner periphery of the orbiting ring may be substantially cylindrical. The roller vanes may be substantially cylindrical, and the outer periphery of the inner rotor may be substantially trochoidal for maintaining contact with the substantially cylindrical roller vanes.

According to another aspect of the invention, provided is another hydraulic motor including a motor housing and a revolving group for revolving in respect to the motor housing. The revolving group includes an inner rotor for rotating in respect to the motor housing, the inner rotor having a plurality of lobes circumferentially spaced along an outer periphery of the inner rotor, and an orbiter surrounding the inner rotor, the orbiter having a plurality of radially-extending rounded portions circumferentially spaced along an inner periphery of the orbiter, and the orbiter also having a plurality of radially outwardly extending fluid windows. The orbiter orbits around the inner rotor in respect to the motor housing. The lobes glide against the radially-extending rounded portions to define a plurality of volume chambers. The orbiter has fixed for movement therewith a plurality of radially outwardly extending fluid windows aligned with the plurality of volume chambers. Spacing between the plurality of fluid windows and the plurality of radially-extending rounded portions remains constant during rotation of the inner rotor and orbiting of the orbiter, thereby preventing direct fluid communication between the volume chambers.

The hydraulic motor may further include a valve plate mounted to the orbiter and having the plurality of fluid windows, where a longitudinal center axis of each of the valve plate and the orbiter follow the same path in orbiting about a fixed longitudinal center axis of the inner rotor, thereby preventing alignment of each fluid window with more than one volume chamber at a time. The lobes and the radially-extending rounded portions glide against one another and interengage at shifting contact points between the lobes and the radially-extending rounded portions, where no shifting contact point passes over a fluid window in the valve plate.

The orbiter may include an orbiting ring surrounding the inner rotor, the orbiting ring having a plurality of inner recesses circumferentially spaced along an inner periphery of the orbiting ring, and a plurality of roller vanes disposed between the inner rotor and the orbiting ring, the roller vanes being received in the inner recesses and forming the radially-extending rounded portions of the orbiter. The hydraulic motor may further include a plurality of motor bolts located between an inner periphery of the motor housing and an outer periphery of the orbiter, where the motor bolts constrain the orbiter from rotating. The hydraulic motor may further include sleeves surrounding the motor bolts for interengaging with the orbiter. The radially-extending rounded portions circumferentially spaced along the inner periphery of the orbiter may be substantially semi-cylindrical portions, and the inner rotor may have a substantially trochoidal outer periphery for remaining in continuous contact with the substantially semi-cylindrical portions of the orbiter.

According to yet another aspect of the invention, a method is provided for utilizing pressurized fluid to produce rotary motion. The method includes the steps of injecting fluid into a motor housing and directing the fluid through a plurality of fluid ports in a commutator assembly coupled to the motor housing, selectively transmitting the fluid through fluid windows of a revolving valve, the revolving valve further including N rotor lobes on an inner rotor for rotating about a fixed longitudinal axis and for interengaging with N+1 radially-extending rounded portions of an orbiter surrounding the inner rotor to form N+1 sealed variable volume chambers therebetween, wherein the fluid windows orbit about the fixed longitudinal axis, selectively expanding some of the sealed volume chambers by providing a pressure differential between the sealed volume chambers to produce a rotary motion of the inner rotor, thereby driving an output shaft interengaged with the rotor, withdrawing through the fluid windows of the revolving valve means the fluid from the sealed volume chambers that have reached their maximum expansion, and exhausting the fluid from the motor housing.

The method may further include the steps of orbiting the orbiter about the fixed longitudinal axis during the rotation of the inner rotor, and preventing rotation of the orbiter about the fixed longitudinal axis via interengagement of the orbiter with a plurality of rods extending into the motor housing.

DETAILED DESCRIPTION

The principles of the present application have general application to hydraulic motors, and particular application to a geroller motor and method of utilizing pressurized fluid to produce rotary motion, and thus will be described below chiefly in this context. The geroller motor may be suitable for use in driving systems such as in conveyors, winches, turrets, or hydraulic transmission systems of vehicles, such as zero-turn-radius mowers. It will of course be appreciated, and also understood, that the principles of the invention may be useful in other applications, in particular in pumps or compressor systems.

Figure 1:
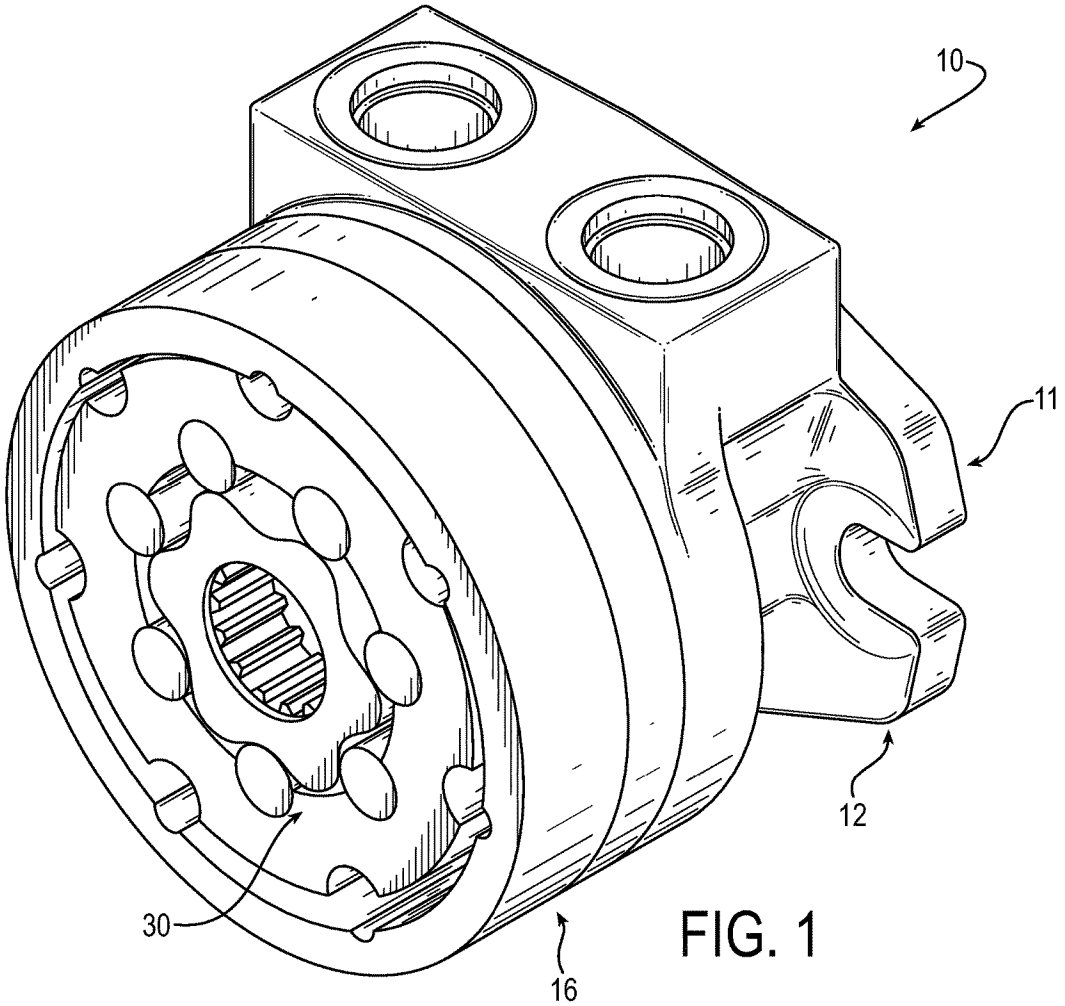
FIG. 1 is a front perspective view of an exemplary hydraulic motor according to the invention, with a forward section and output shaft removed.
Figure 2:
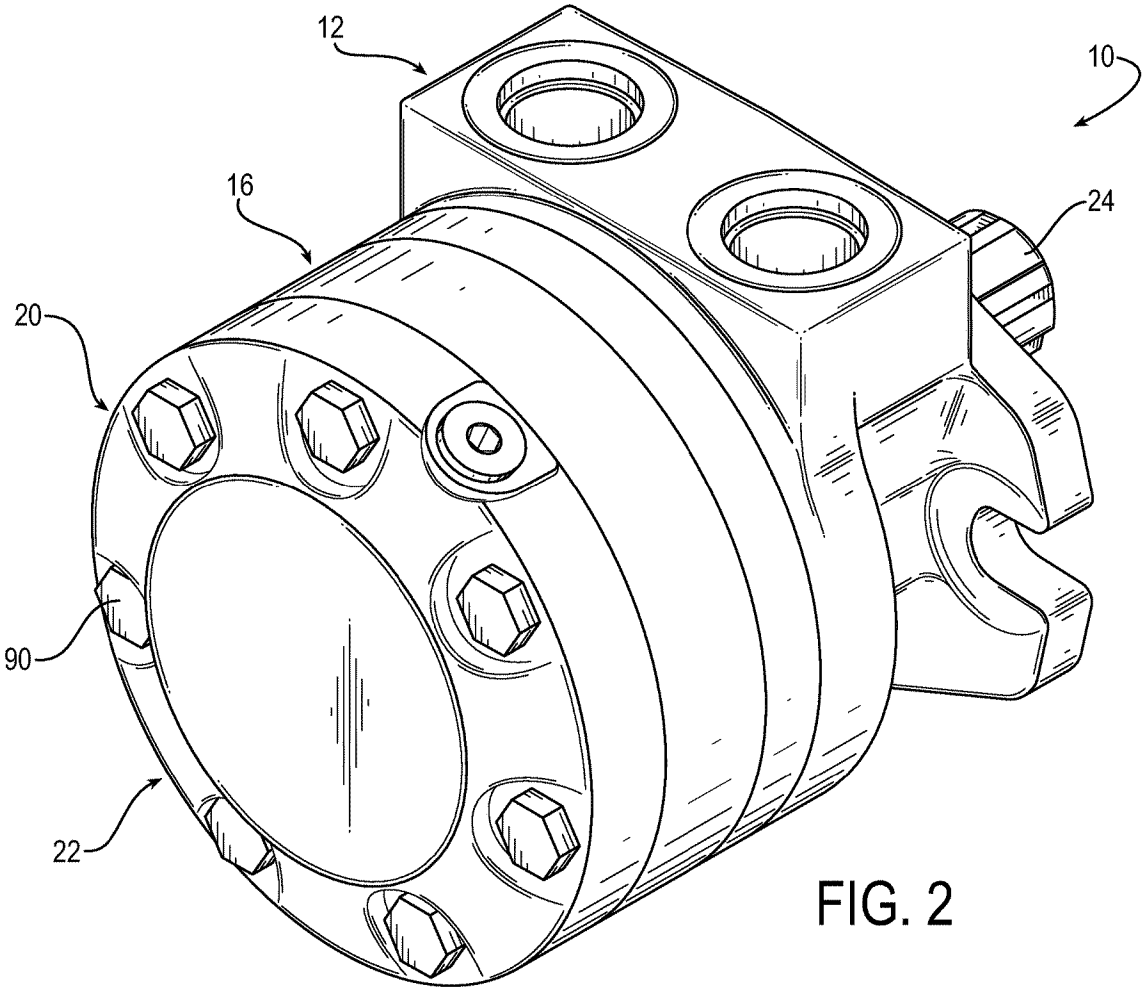
FIG. 2 is a front perspective view of the exemplary hydraulic motor of FIG. 1 with the forward section and output shaft installed.
Figure 3:
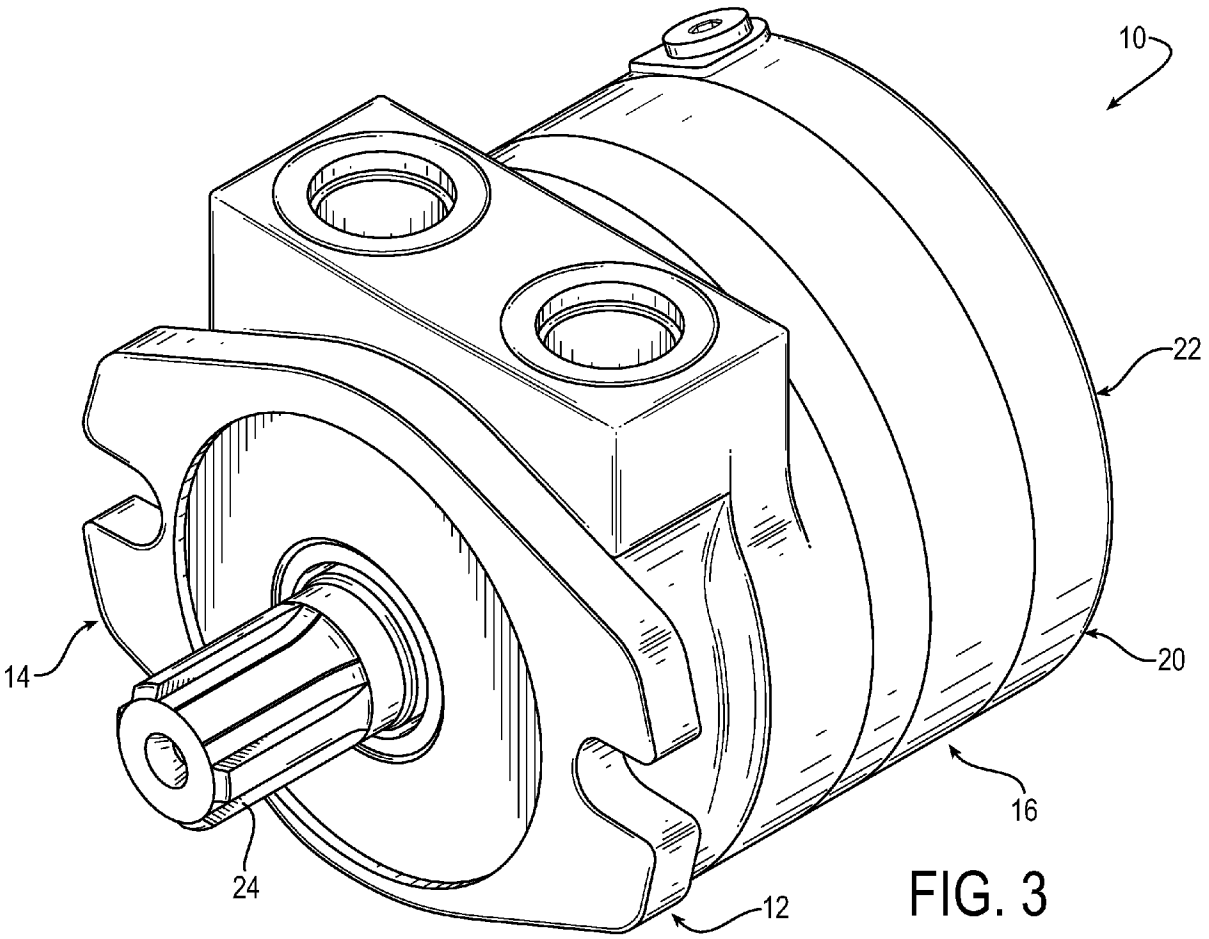
FIG. 3 is a rear perspective view of the exemplary hydraulic motor of FIG. 2.

Referring now to the drawings in detail, and initially to FIGS. 1-3, an exemplary hydraulic motor is illustrated at reference numeral 10. The hydraulic motor 10 includes a plurality of axially aligned longitudinally adjacent sections. The sections include a rear commutator and bearing section 12 at the fluid delivery and exhaust end or rear end 14 of motor 10, an intermediate geroller section 16 located axially adjacent the section 12, a forward bearing section 20 located adjacent the work end or forward end 22 of the motor 10, and a work or output shaft 24 that is coaxially received within the sections 12, 16, and 20.

Figure 4:
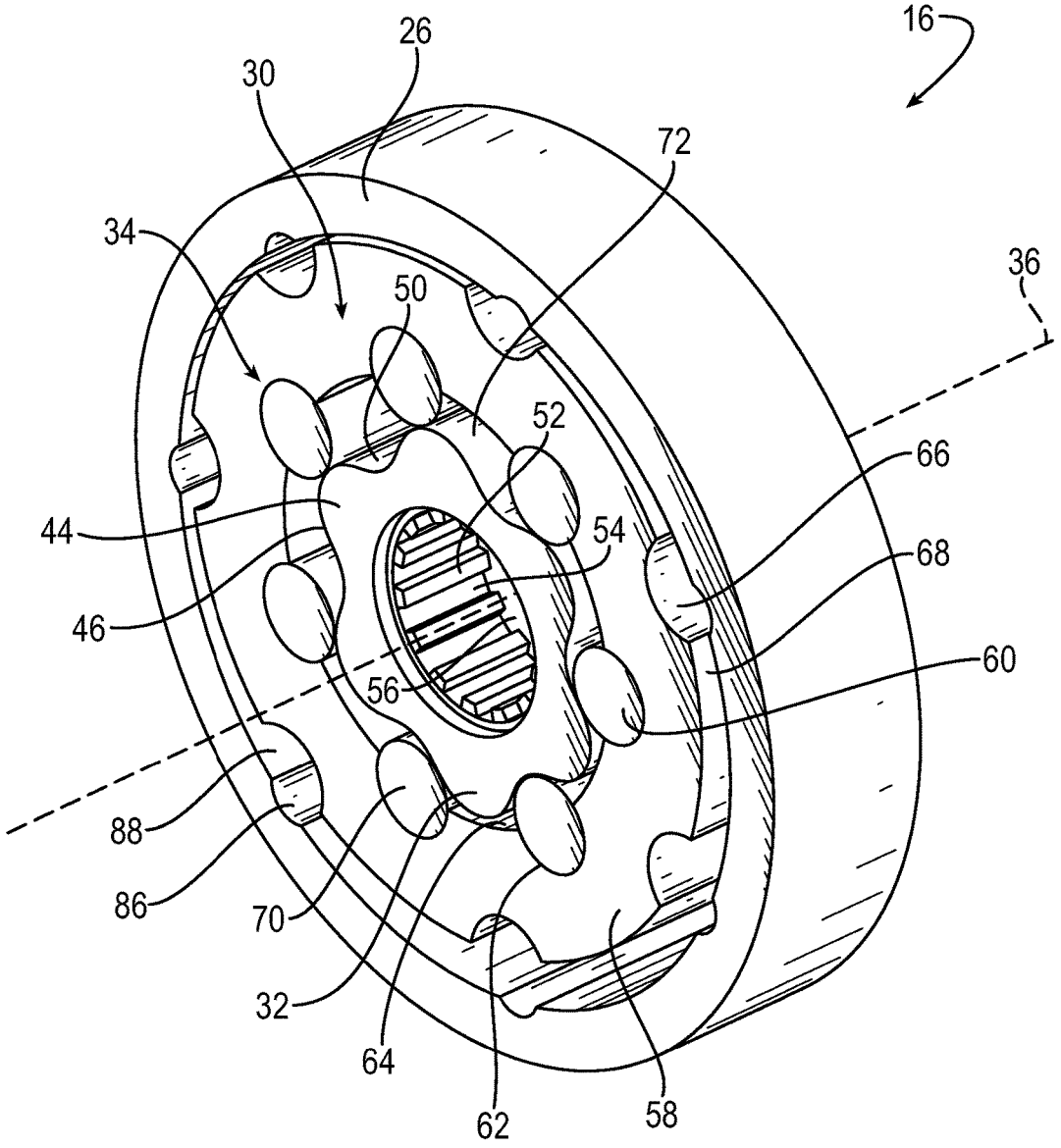
FIG. 4 is a front perspective view of an intermediate section of the exemplary hydraulic motor of FIG. 1 showing a revolving group.
Figure 5:
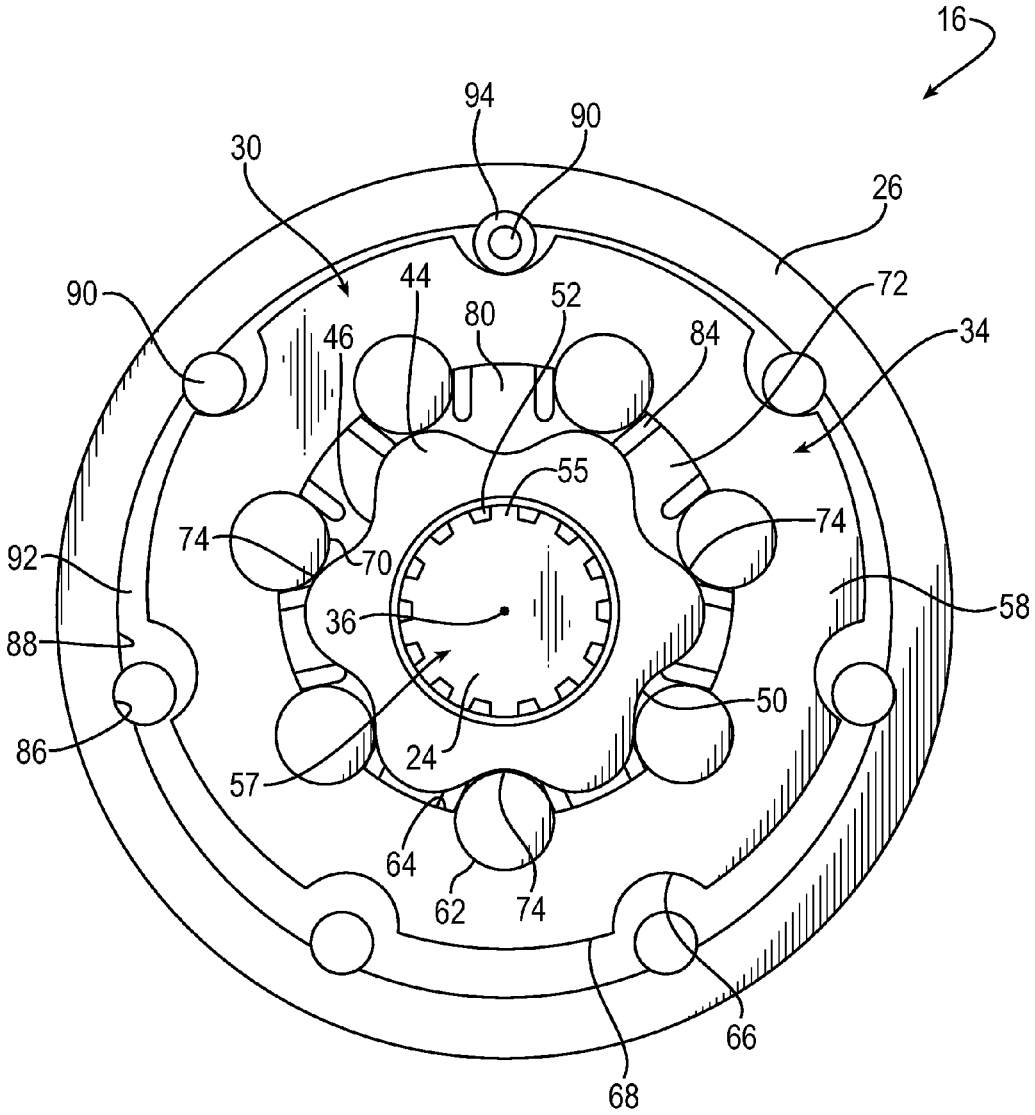
FIG. 5 is a front view of the intermediate section.
Figure 6:
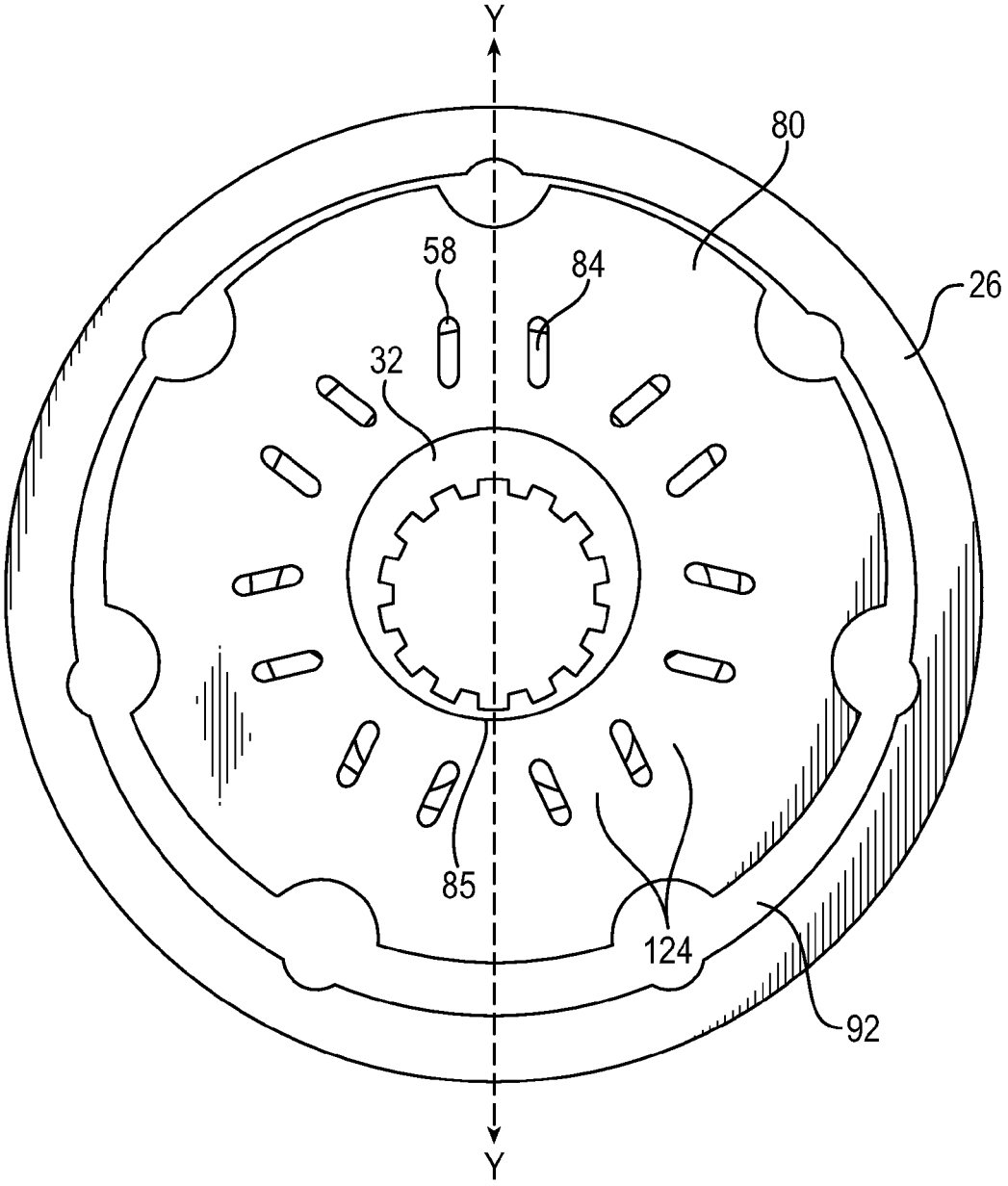
FIG. 6 is a rear view of the intermediate section.
Figure 7:
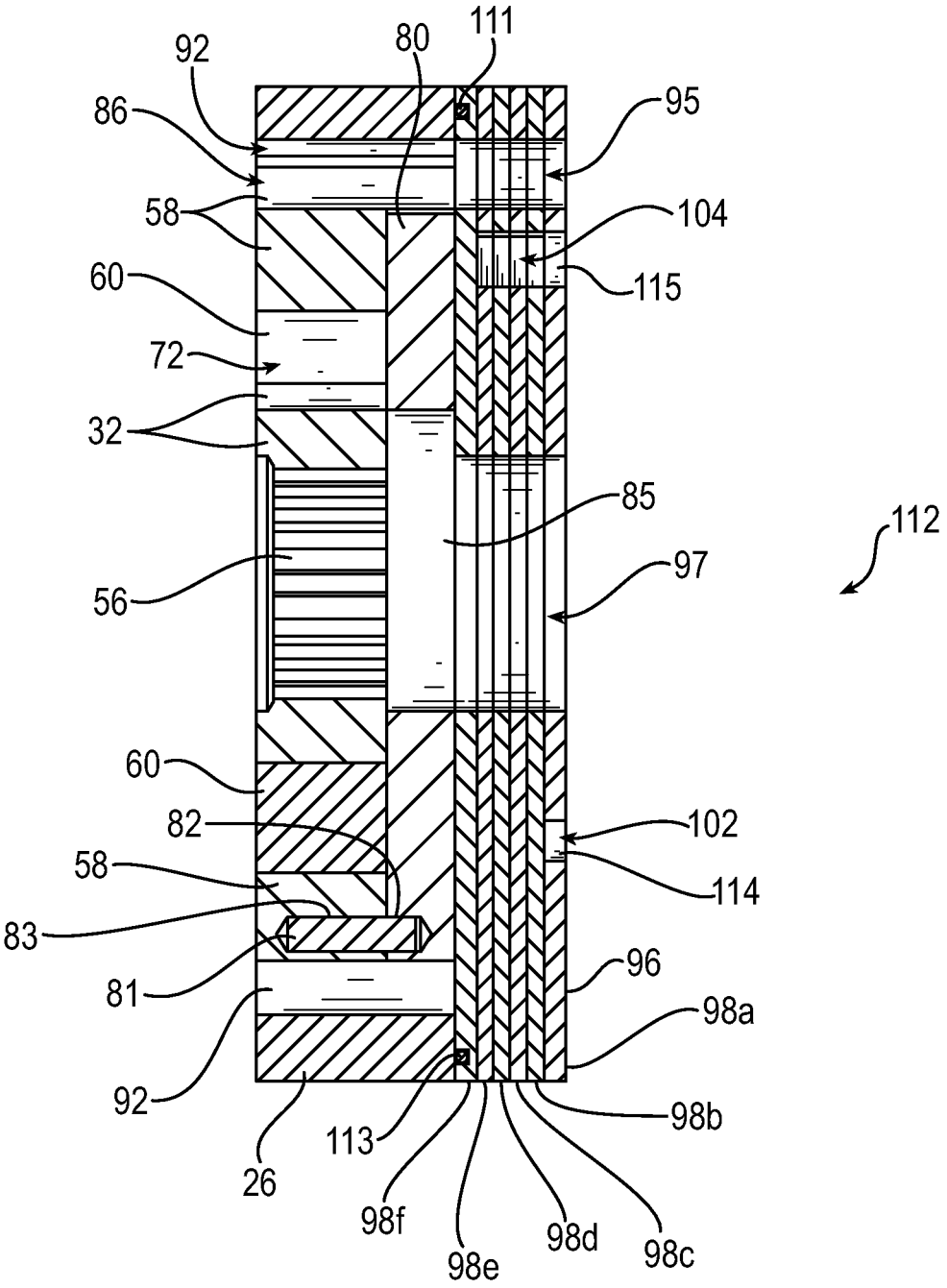
FIG. 7 is a cross-sectional view of the intermediate section and commutator assembly, shown at the y-plane of FIG. 6.
Figure 8:
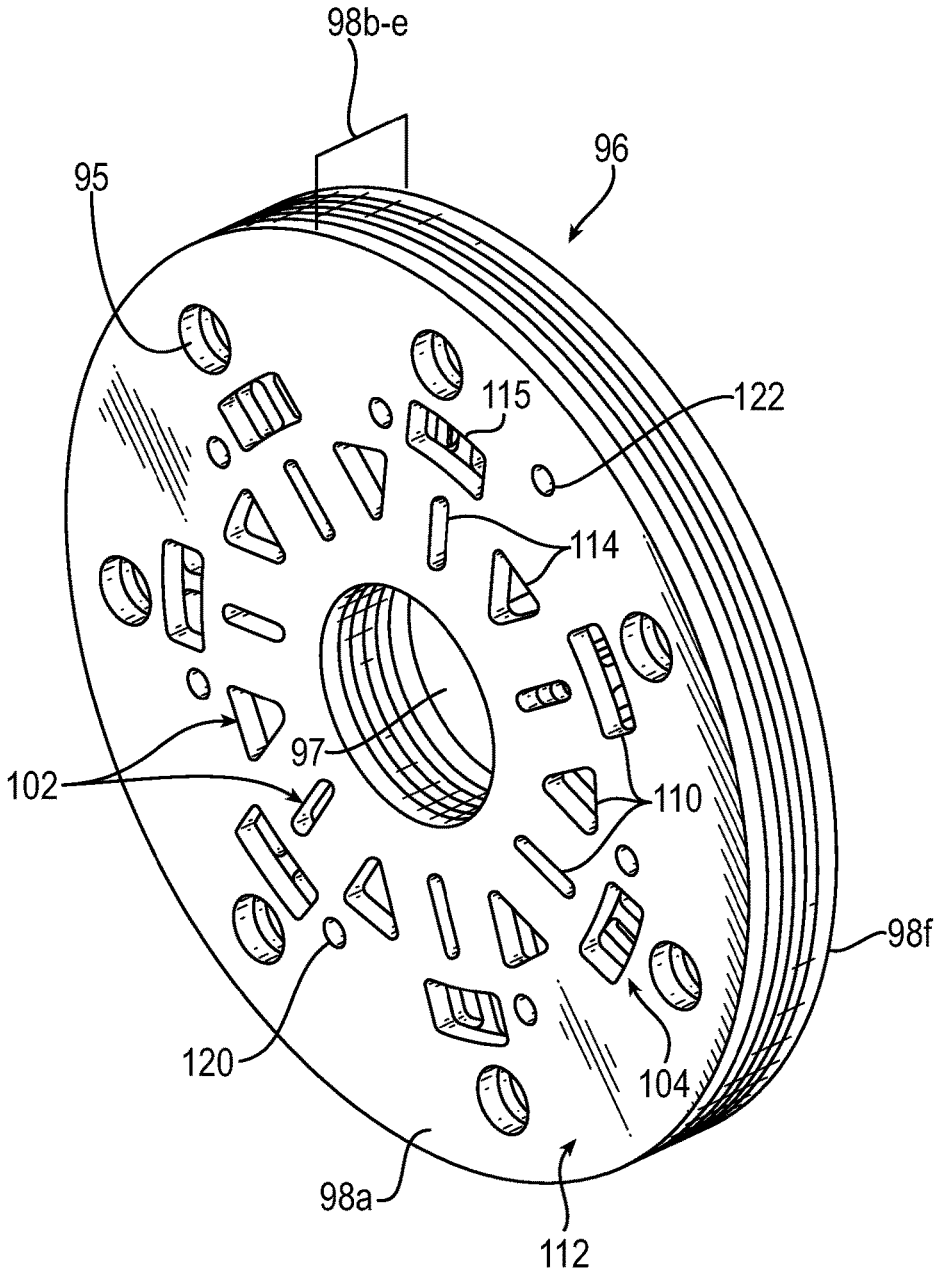
FIGS. 8-11 are various views of exemplary commutator plates of the commutator assembly for use in the exemplary hydraulic motor of FIG. 1.

Turning to FIGS. 4-6, the intermediate geroller section 16 includes a center housing 26 that receives a geroller set. The center housing 26 may be any suitable material such as ductile iron, gray iron, compressed powdered metal, etc. The geroller set, such as the revolving group 30, receives and is acted upon by fluid, such as hydraulic fluid, directed into the hydraulic motor 10 from an outside source, such as a hydraulic pump. The revolving group 30 includes two revolving members, an inner rotor 32 and an orbiter 34, which revolve in respect to one another within the center housing 26 and in respect to a fixed longitudinal axis 36. As will herein be understood, revolving motion includes each of rotational and orbital motion. The inner rotor 32 is rotatable about the fixed longitudinal axis 36, which extends longitudinally through the output shaft 24 and is coincident with respect to a center longitudinal axis of the motor 10. The orbiter 34 surrounds the inner rotor 32 and orbits about the inner rotor 32 and in respect to the fixed longitudinal axis 36.

The inner rotor 32, which may be any suitable material such as steel, etc., includes a plurality of teeth, such as lobes 44, circumferentially spaced along an outer periphery 46 of the inner rotor 32. The lobes 44 define therebetween a plurality of radially inwardly directed outwardly open pockets 50 for receiving portions of the orbiter 34. The inner rotor 32 also includes a plurality of radially inwardly extending rotor splines 52 circumferentially spaced along an inner periphery 54 of the inner rotor 32. The inner periphery 54 defines an inner bore 56 extending through the inner rotor 32 for receiving the output shaft 24. The rotor splines 52 are configured to engage with shaft splines 55 circumferentially spaced about a forward end 57 of the output shaft 24. The shaft 24 may be any suitable material such as hardened machined steel, etc. It will be appreciated that in a situation where the motor 10 acts as a hydraulic pump, the output shaft 24 may act as an input or driving member in contrast to acting as an output or driven shaft in a motor.

The orbiter 34 includes an orbiting ring 58 surrounding and for orbiting about the inner rotor 32. The orbiter 34 also includes a plurality of roller bearings, such as roller vanes 60, received in the orbiting ring 58 for common orbiting with the orbiting ring about the longitudinal fixed axis. The orbiting ring 58, which may be any suitable material such as steel, etc., includes a plurality of inner recesses 62 circumferentially spaced along an inner periphery 64 of the orbiting ring 58. The orbiting ring 58 also includes a plurality of outer recesses 66 circumferentially spaced along an outer periphery 68 of the orbiting ring 58.

Received in the inner recesses 62 are the plurality of roller vanes 60, which may be any suitable material such as machined steel, etc. The roller vanes 60 seal fluid between themselves and the orbiting ring 58. As shown, each inner recess 62 is substantially cylindrical and has a diameter greater than an external diameter of a roller vane 60. Each inner recess 62 is configured to receive and retain a respective roller vane 60 via a circumferential extent greater than 180-degrees extending beyond an equator of the roller vane 60, conforming to and securing the roller vane 60 in the inner recess 62. The configuration allows each roller vane 60 to rotate within and in respect to each respective inner recess 62. A semi-cylindrical portion 70 of each roller vane 60 extends radially outwardly from a substantially cylindrical inner periphery 64 of the orbiting ring 58. It will be appreciated that the circumferential extent of the inner recesses 62 may instead be lesser than 180-degrees, and the vanes 60 may instead be retained in the recesses via dimensional tolerancing between the orbiter 34 and the inner rotor 32.

As compared with other hydraulic motors, the arrangement of the lobes 44 and roller vanes 60 provides for increased manufacturing efficiency. Due to the generated nature of a lobed profile, a profile grind to form a lobed internal periphery of a part is significantly more difficult, expensive, and inefficient to perform than a profile grind to form a lobed outer periphery of a part. By including the lobes 44 on the outer periphery 46 of the inner rotor 32 rather than on the internal periphery 64 of the orbiting ring 58, the difficult machining operations of an internal profile grind to form the generated lobed profile is eliminated.

As a result of the lobed profile of the outer periphery 46 of the inner rotor 32, the roller vanes 60 and the lobes 44 of the inner rotor 32 interengage with one another to define a plurality of expanding and contracting volume chambers 72 therebetween. Generally, rotation of the inner rotor 32 and orbiting of the orbiter 34 with respect to one another causes the volume chambers 72 to change volume. More particularly, to form the volume chambers 72, the inner rotor 32 includes N lobes 44, such as the illustrated six lobes 44. The lobes 44 define therebetween N pockets 50, such as the illustrated six pockets 50. The lobed outer periphery 46 of the inner rotor 32 is trochoidal in shape to provide a curve along which the lobes 44 may remain in continuous contact with the roller vanes 60. The lobes 44 and roller vanes 60 may remain in contact at shifting contact points 74 as the inner rotor 32 and the orbiter 34 revolve with respect to one another and as the roller vanes 60 rotate within the inner recesses 62.

The orbiter 34 may include N+1 inner recesses 62, such as the illustrated seven inner recesses 62 on the orbital ring 58, corresponding to N+1 roller vanes 60, such as the illustrated seven roller vanes 60, received therein. The roller vanes 60 may be spaced circumferentially about the inner periphery 64 of the orbiting ring 58 so as to provide the continuous contact, or continuous conjugate interaction, between the roller vanes 60 and the lobes 44 and pockets 50 of the inner rotor 32. The interengagement of the inner rotor 32 with the orbiter 34 may define N+1 volume chambers 72, such as the illustrated seven expanding and contracting volume chambers 72. It will be appreciated that the orbiter 34 may instead include any suitable number of inner recesses 62 corresponding to a suitable number of lobes 44 of the inner rotor 32.

With this arrangement, each lobe 44 may glide against the roller vanes 60 as the inner rotor 32 rotates and as the orbiting ring 58 orbits about the rotor 32. Each roller vane 60 may roll successively from lobe 44, to adjacent pocket 50, to next adjacent lobe 44, and so on around the outer periphery 46 of the inner rotor 32. Hydraulic fluid directed into the revolving group 30 may be sealed between each pair of adjacent roller vanes 60, a portion of the orbiting ring 58 extending therebetween, and the lobe or portions of lobes 44 gliding against the two adjacent roller vanes 60.

The hydraulic fluid may be directed into and out of the continually expanding and contracting volume chambers 72 via radially outwardly extending fluid windows 84 fixed for movement with the orbiter 30. A valve plate 80 including the fluid windows 84 may be integral with the orbiter 34, and more particularly with the orbiting ring 58. The valve plate 80 may be any suitable material such as compressed powdered metal, machined steel, etc. The valve plate 80 may be mounted to the orbiting ring 58 via attachment means, such as via engagement pins 81 or other suitable attachment means such as bolting, brazing, or soldering. As shown, the pins 81 are received in inwardly axially extending recesses 82 of the valve plate 80 and corresponding inwardly axially extending recesses 83 of the orbiting ring 58. A longitudinal center axis of each of the valve plate 80 and the orbiter 34 may follow the same path in orbiting about the fixed longitudinal center axis 36. A center bore 85 may extend axially through the plate 80 for receiving the output shaft 24.

The radially outwardly extending fluid windows 84 extend through the valve plate 80 for directing the hydraulic fluid into the volume chambers 72. As shown, a pair of fluid windows 84 aligns with each volume chamber 72. Each respective pair of fluid windows 84 may remain aligned between a respective pair of roller vanes 60 due to the valve plate 80 being integral with the orbiting ring 58. The spacing between the fluid windows 84 and roller vanes 60 prevents fluid communication between volume chambers 72. Specifically, during the combination of rotating and orbiting of the members of the revolving group 30, no fluid window 84 may be caused to align with more than one volume chamber 72 at a time. Further, no shifting contact point 74 between the lobes 44 and pockets 50 and the roller vanes 60 may be caused to align with a fluid window 84, thereby also preventing fluid from moving between volume chambers 72.

It should be noted that were the relationship between the fluid windows 84 and the roller vanes 60 not constant, each shifting contact point 74 would align with a fluid window 84 at some point in the revolution of the revolving members, i.e., the inner rotor 32 and the orbiter 34. For instance, if the roller vanes 60 were received in the orbiting ring 58 and the valve plate 80 was integral with the rotating inner rotor 32, rather than with the orbiting ring 58, the combination of rotating of the inner rotor 32 and orbiting of the orbiting ring 58 would cause the contact points 74 to align with the fluid windows 84. Alternatively, if the roller vanes 60 were received in the inner rotor 32 and the valve plate 80 was integral with the orbiting ring 58, the contact points 74 would again be caused to align with the fluid windows 84.

Turning now to the center motor housing 26, constraint means are provided for constraining rotation of the orbiter 34, and particularly for constraining rotation of the orbiting ring 58, about the fixed longitudinal axis 36. The center motor housing 26 may include a plurality of recesses 86 spaced circumferentially about an inner periphery 88 of the center housing 26. Received in the recesses 86 may be pins, such as motor bolts 90, which may be any suitable material such as steel, etc. As shown, the motor bolts 90 may extend axially through each of the forward and intermediate sections 12, 16 and into the rear section 20 for affixing the sections 12, 16, 20 together. The inner recesses 86 may open radially inwardly to an outer chamber 92 defined by the outer periphery 68 of the orbiting ring 58 and the inner periphery 88 of the center housing 26. The inner recesses 86 may be configured such that a portion of each of the motor bolts 90 extends radially inwardly beyond the inner periphery 88 of the center housing 26 to form radially inwardly extending protrusions. The motor bolts 90 may interengage with the outer recesses 66 of the orbiting ring 58, which have diameters larger than the diameter of the motor bolts 90. Accordingly, the interengagement between the outer recesses 66 and the motor bolts 90 may constrain the orbiting ring 58 from rotating, and thereby allow the orbiting ring 58 to orbit but not rotate about the center axis 36. It will be appreciated that the motor bolts 90 may instead be received in other holes or recesses (not shown) of the center motor housing 26, and additional vanes, similar to the roller vanes 60 may instead be received in the inner recesses 86 for interengaging with the orbiting ring 58. It will also be appreciated that one or more of the housings, such as the center housing 26, may be unitary with one or more of the other housings and collectively may be referred to as a housing.

The center motor housing 26 may include N+1 recesses 86, such as the illustrated seven recesses 86, corresponding to N+1 outer recesses 66 of the orbiting ring 58, such as the illustrated seven recesses 66. One of ordinary skill will realize that the orbiting ring 58 may have an increased structural strength where each outer recess 66 is circumferentially spaced between a pair of inner recesses 62. It will be appreciated that the center motor housing 26 may instead include any suitable number of inner recesses 86 corresponding to a suitable number of outer recesses 66 of the orbiting ring 58.

The motor bolts 90 may also include sleeves 94, such as the sleeve 94 shown at the motor bolt 90 located at a twelve-o'clock location in FIG. 5. The sleeves 94 may be any suitable material such as machined steel, etc. The sleeves 94 may surround at least a portion of one or more motor bolts 90 extending through the intermediate housing section 16 to engage with the outer recesses 66 of the orbiting ring 58. The sleeves 94 may rotate about the bolts 90, allowing for the orbiting ring 58 to glide against the sleeves 94.

Referring now to FIGS. 7-13, the rear commutator and bearing section 12 of FIGS. 1-3 includes a commutator assembly 96 and a rear motor housing 100. The commutator assembly 96 may be coupled, such as mounted, to the rear motor housing 100, and also to the center motor housing 26 via pins, such as the motor bolts 90, extending through motor bolt holes 95 in the commutator assembly 96. The commutator assembly 96 is held stationary in relation to the rotation and orbiting of the revolving group 30. The motor bolt holes 95 are spaced circumferentially about a radially outward extent of the commutator assembly 96. It will be appreciated that other suitable methods of mounting may be used, such as brazing or soldering. A center bore 97 extends axially through the commutator assembly 96 for receiving the shaft 24.

The commutator assembly 96 includes a series of apertured individual plates 98*a-f*, which may be any suitable material such as steel, low to medium carbon steel, etc. The plates 98*a-f* are affixed together in order to form two separate sets of fluid ports 102, 104 for aligning with the fluid windows 84 of the orbiting valving means or valve plate 80. One of the sets of fluid ports is a set of high pressure fluid ports 102 for directing only high pressure hydraulic fluid through the motor 10. The other of the sets of fluid ports is a set of low pressure fluid ports 104 for directing only low pressure hydraulic fluid through the motor 10. The fluid ports 102, 104 direct fluid to the fluid windows 84 as the valve plate 80 orbits integral with the orbiter 34, thereby placing the fluid windows 84 into alignment with the fluid ports 102, 104. It will be appreciated that depending on the desired rotational direction of the output shaft 24, the fluid ports 102 may direct low pressure and the fluid ports 104 may direct high pressure.

Figure 9:
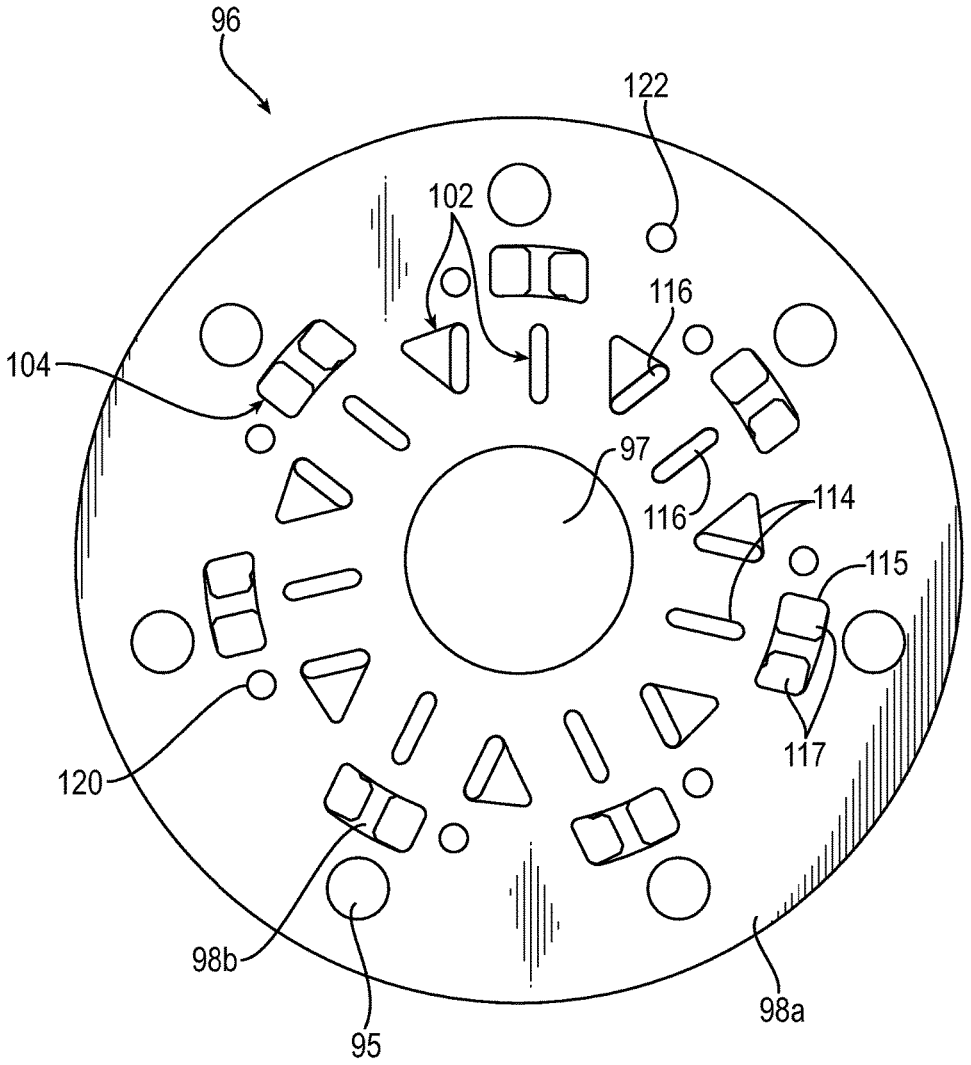
Figure 10:
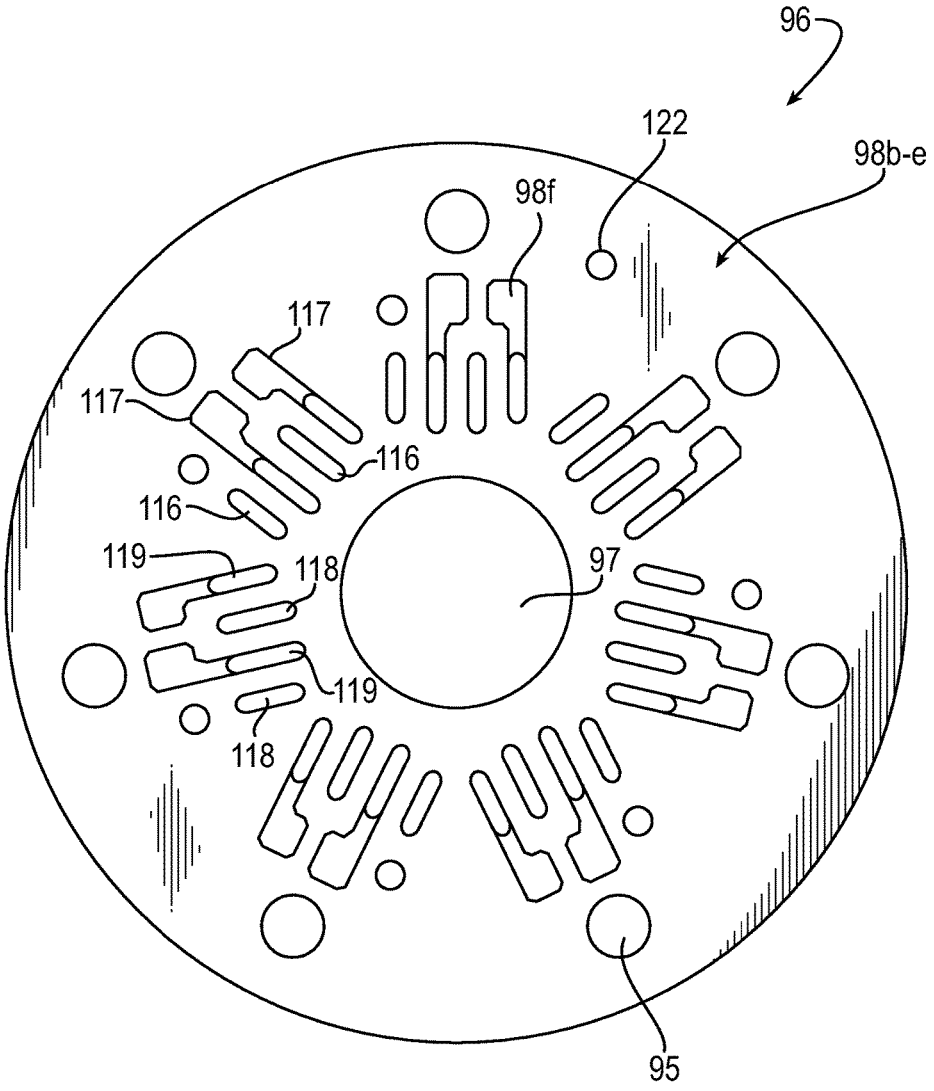
Figure 11:
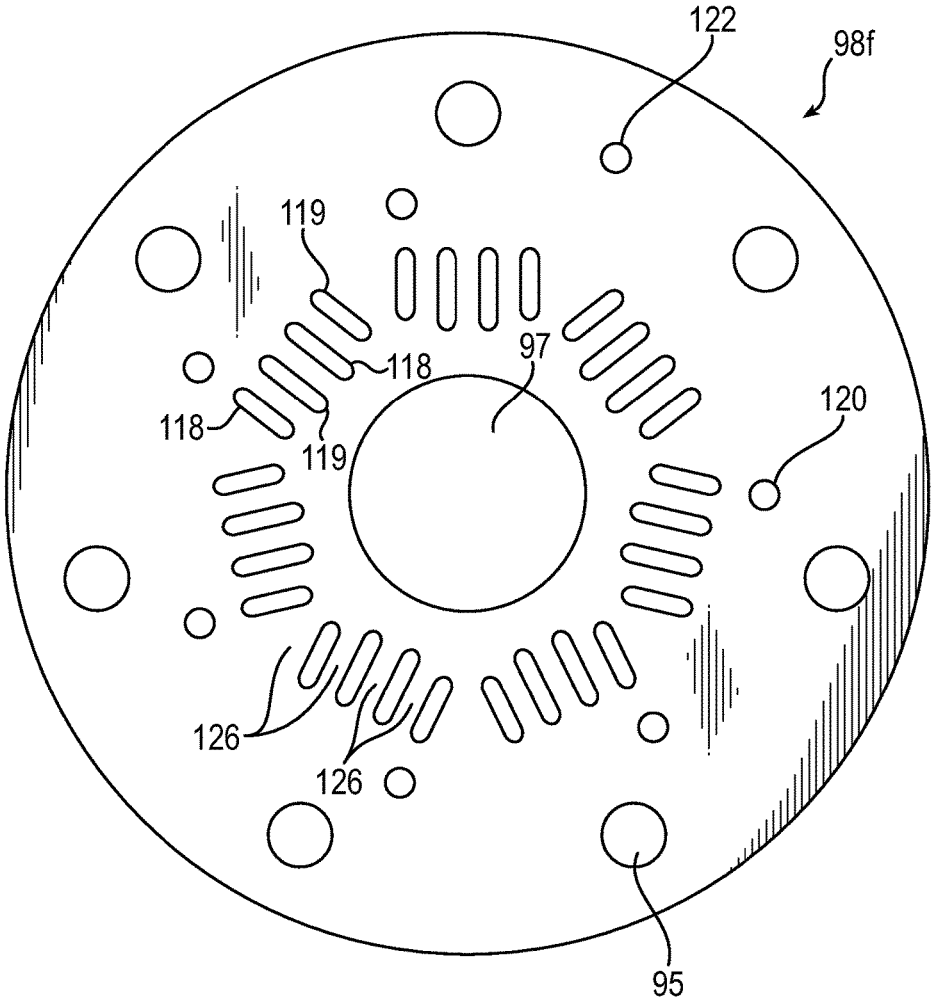
Figure 12:
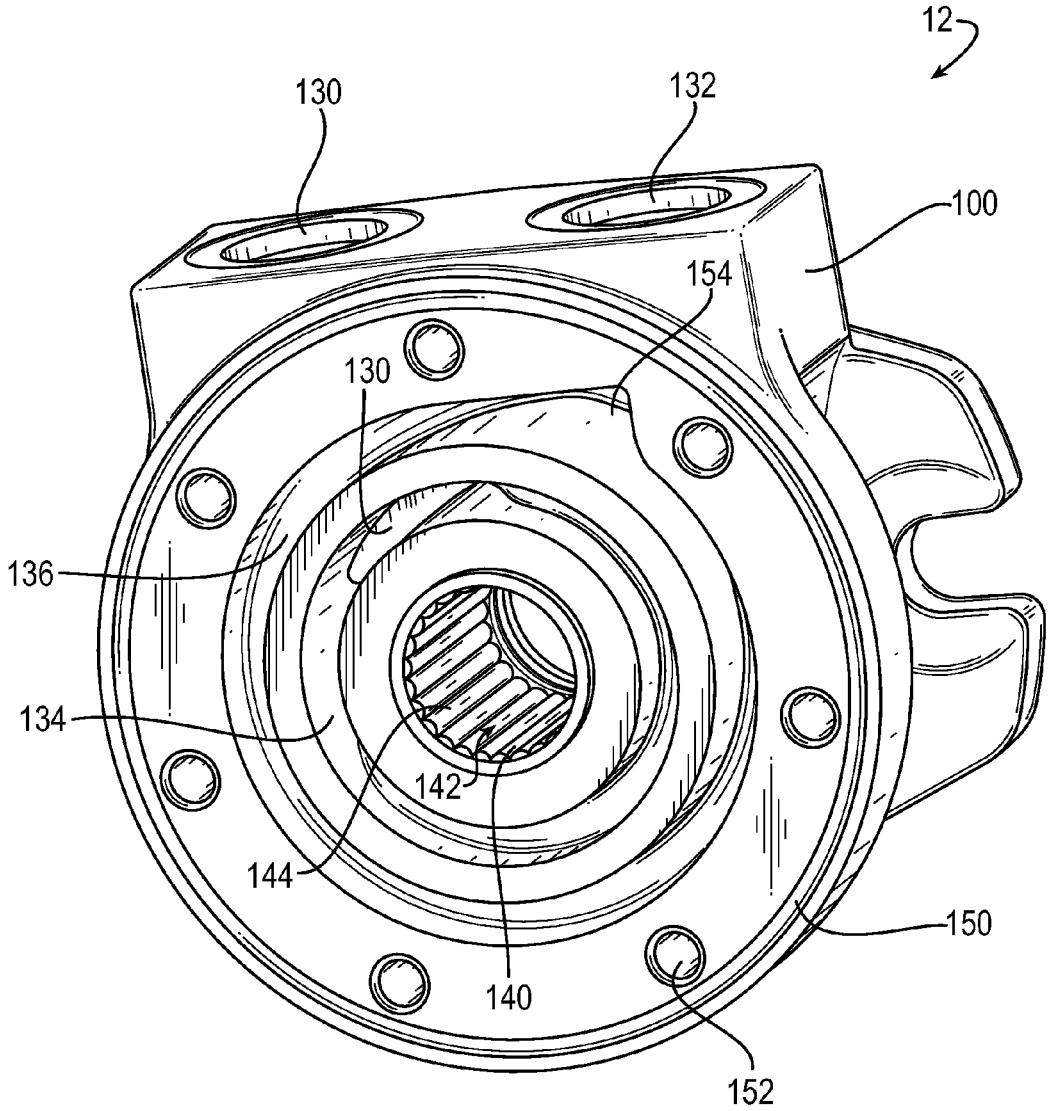
FIGS. 12 and 13 are front perspective views of the rear casing of the hydraulic motor of FIG. 1.
Figure 13:
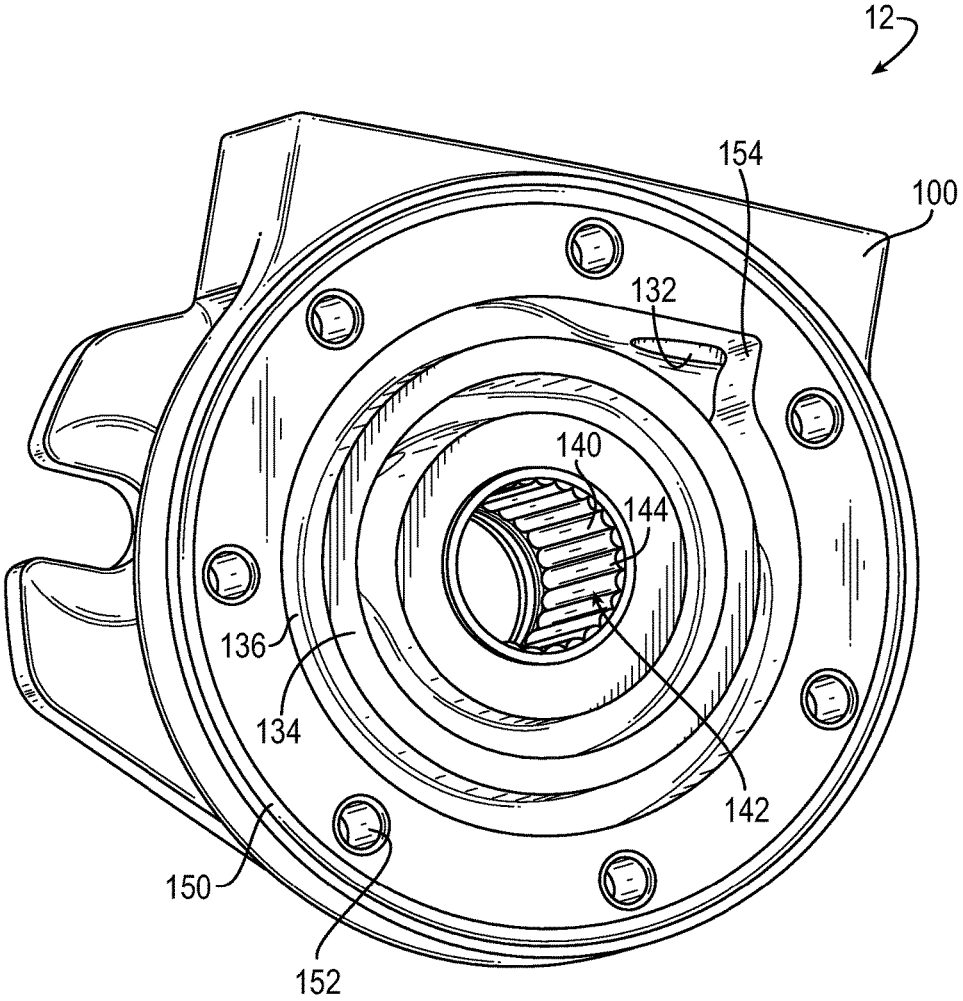

The commutator plates 98*a-f* of the commutator assembly 96 may be aligned together via peripherally-spaced pins (not shown) and then soldered to one another, although any other suitable method of affixation, such as brazing or bolting, may be utilized. The commutator assembly 96 specifically includes one rear plate 98*a*, affixed adjacent four identical intermediate plates 98*b-e*, affixed adjacent one forward plate 98*f*. The rear plate 98*a* is located adjacent the rear motor housing 100. The forward plate 98*f* is located adjacent the valve plate 80 and the center housing 26 (FIG. 4). A seal ring 111 may be disposed in an annular groove 113 of the forward plate 98*f*, and thus between the forward plate 98*f* and the center housing 26, for preventing hydraulic fluid contained therein from leaking out of the motor 10. As shown, each plate 98*a-f* has a plurality of fluid apertures 110 for aligning to form the fluid ports 102, 104. Note that each of FIGS. 9-11 illustrates views of the commutator assembly 96 from the assembly's forward side 112. FIG. 9 shows a view of all of the plates 98*a-f*, FIG. 10 shows a view of only plates 98*b-f* with plate 98*a* removed, and FIG. 11 shows a view of only plate 98*f* with plates 98*a-e* removed.

Each commutator plate 98*a-f* may include N+1 separate sets of high pressure apertures and low pressure apertures, such as the illustrated seven sets of apertures 114 and 115, 116 and 117, 118 and 119, for aligning in respect to the N+1 volume chambers 72. The sets of apertures extend through each respective plate 98*a-f* for separating high pressure fluid being delivered to the motor 10 from low pressure fluid being exhausted from the motor 10. The high pressure apertures 114, 116, 118 align to form the high pressure fluid ports 102, and the low pressure apertures 115, 117, 119 align to form the low pressure fluid ports 104. Each commutator plate 98*a-f* may also include pin apertures 120 for receiving the peripherally-spaced pins for aligning the plates 98*a-f* in respect to one another. An auxiliary aperture 122 may extend through each plate 98*a-f* and align with the outer chamber 92 located between the orbiting ring 58 and the center housing 26. Alignment of the auxiliary apertures 122 may allow for the motor 10 to be configured as a two-chamber or a three-chamber motor, to be discussed in greater detail later.

The rear commutator plate 98*a* includes high pressure apertures 114, arranged circumferentially about a radially inward extent of the rear commutator plate 98*a*, and low pressure apertures 115, arranged circumferentially about a radially outward extent of the rear commutator plate 98*a*. The intermediate commutator plates 98*b-e* include circumferentially arranged alternating sets of four high and low pressure apertures 116, 117. As shown, the arrangement of each set of apertures 116, 117 alternates from left to right in the order of high pressure aperture 116, low pressure aperture 117, high pressure aperture 116, and low pressure aperture 117. The low pressure apertures 117 of the intermediate commutator plates 98*b-e* extend farther radially outward than the pair of high pressure apertures 116 in order to align with the low pressure apertures 115 of the rear commutator plate 98*a* when stacked together. The apertures 118, 119 extending through the forward commutator plate 98*f*, for aligning with the apertures 116, 117, are arranged in the same order as the apertures 116, 117 of the intermediate plates 98*b-e*. It will be appreciated that the plates 98*b-f* could include any suitable number of apertures in each of the seven sets of apertures, or the plates 98*b-f* could include any suitable number of sets of apertures consistent with the number of volume chambers 72.

During rotation of the inner rotor 32 and orbiting of the orbiter 34, the fluid windows 84 are configured to orbit between the high pressure apertures 118 and the low pressure apertures 119 of the forward commutator plate 98*f*. The fluid windows 84 (FIG. 5) of the valve plate 80 (FIG. 5) and the apertures 118, 119 may also be configured, such as sized large enough, to provide the least possible pressure loss across the system as is possible based on the eccentricity of the orbiter 34. It should be noted that greater aperture area provided in a commutator plate corresponds to lesser pressure loss across the system, and thus more efficient driving of the inner rotor 32 and associated output shaft 24.

It should also be noted that use of half the number of apertures 116-119 and half of the number of fluid windows 84 would result in a less efficient hydraulic motor. For example, a single high pressure aperture 116, 118 and a single low pressure aperture 117, 119 in each of the seven aperture sets of the commutator plates 98*b-f*, and correspondingly a single fluid window 84 for orbiting between the apertures, would result in a less efficient hydraulic motor 10. This is because a lesser amount of hydraulic fluid would valve into and out of the intermediate geroller section 16, resulting in pressure loss across the system.

In such a construction having half the number of apertures and fluid windows, were the areas of each of the fluid apertures and fluid windows increased as compared to the areas of each of the fluid apertures 116-119 and fluid windows 84 of the motor 10, respectively,—to attempt to increase the motor efficiency—hydraulic fluid would leak between high and low pressure fluid ports 102, 104. For example, the valve plate 80 (FIG. 6) includes valve plate portions 124 (FIG. 6) spaced between the fluid windows 84, and the forward commutator plate 98*f* includes commutator plate portions 126 spaced between the apertures 118, 119. Due to the orbiting nature of the orbiter 34 in respect to the stationary commutator assembly 96, larger fluid apertures and larger fluid windows would result in lesser overlap of the plate portions 124, 126. Minimized overlap of plate portions 124, 126 would therefore lead to leakage from the high pressure fluid ports 102 to the low pressure fluid ports 104, resulting in an even less efficient hydraulic motor 10. Accordingly, the sizing and location of the fluid apertures 118, 119 and of the fluid windows 84 are configured as illustrated to provide for increased efficiency of the motor 10, although suitable alternate configurations may be utilized.

Referring now to the rear motor housing 100 of the rear section 12, hydraulic fluid is delivered to and from the commutator assembly 96 via passages through the rear motor housing 100. The rear motor housing 100, which may be any suitable material such as ductile iron, gray iron, or compressed powdered metal, etc., includes separate inlet and outlet ports 130, 132 for coupling to an external hydraulic pump (not shown). Delivered high pressure fluid entering the inlet port 130 is directed to an annular inlet passage 134 in the rear housing 100. The annular inlet passage 134 is disposed in a radially inward extent of the rear housing 100 for aligning with only the high pressure apertures 114 of the rear commutator plate 98*a*, and thus with only the high pressure fluid ports 102. Exhausted low pressure fluid exits only the low pressure apertures 115 of the rear commutator plate 98*a*, and of the low pressure fluid ports 104, and is directed to an annular outlet passage 136 in the rear housing 100. The annular outlet passage 136 is disposed in a radially outward extent of the rear housing 100 and is fluidly connected to the outlet port 132. As such, the commutator and bearing section 12 of the hydraulic motor 10 may provide for separate high and low pressure pathways between an external hydraulic pump and the fluid windows 84 of the valve plate 80. It will be appreciated that in a situation where the motor 10 acts as a hydraulic pump, the inlet port 130 may be an outlet port and the outlet port 132 may be an inlet port.

The rear motor housing 100 also includes additional features. A center bore 140 for receiving the output shaft 24 extends axially through the rear housing 100. A rear shaft chamber 142 is defined by the center bore 140 and surrounds the portion of the shaft 24 extending through the rear housing 100. Bearings 144 for supporting the output shaft 24 may be located in the rear shaft chamber 142. An annular seal groove 150 may be defined by a radially outward portion of the rear housing 100 for receiving a seal ring (not shown) for sealing between the rear housing 100 and the commutator assembly 96. The rear housing 100 may also include N+1 motor bolt holes 152, such as the illustrated seven motor bolt holes 152, extending at least partially axially through a radially outward extent of the rear housing 100 located radially outward of the annular outlet passage 136. The motor bolt holes 152 may be threaded to receive a threaded portion of the motor bolts 90. The annular outlet passage 136 includes a radially outwardly protruding outlet portion 154 for aligning with the auxiliary aperture 122 extending through each of the commutator plates 98*a-f*. Alignment of each of the auxiliary apertures 122 with one another and with the outlet portion 154 may allow for fluid communication between the outer chamber 92 and the outlet port 132 of the rear housing 100.

Figure 14:
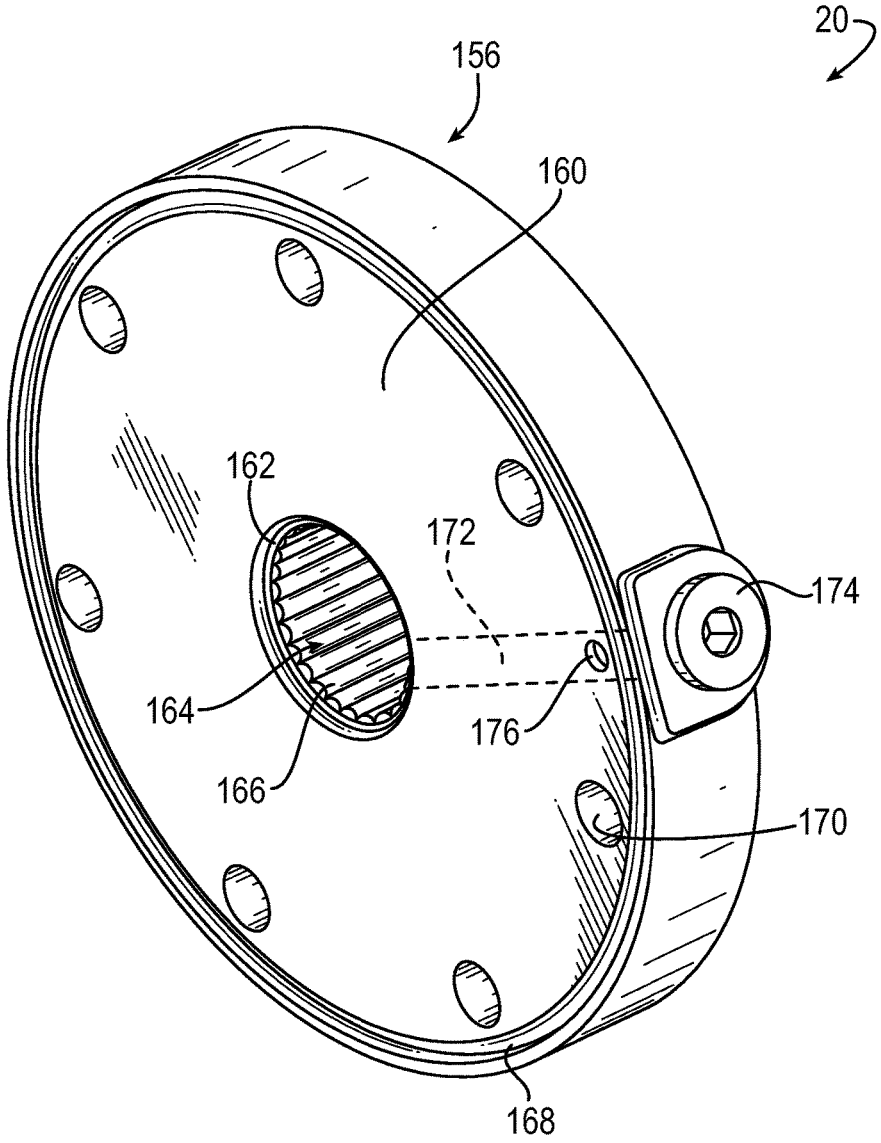
FIG. 14 is a rear perspective view of the forward housing of the hydraulic motor of FIG. 1.

Turning now to FIG. 14, a forward housing 156 of the forward bearing section 20 (FIGS. 1-3) is illustrated. The forward housing 156 may be any suitable material such as ductile iron, gray iron, or compressed powdered metal. The forward housing 156 includes a mating surface 160 for mating against the revolving group 30, thereby sealing a forward end of the volume chambers 72. A center bore 162 extends partially axially through the forward housing 156 for receiving the forward end 57 (FIG. 5) of the output shaft 24. A forward shaft chamber 164 is defined by the center bore 162 and surrounds the portion of the shaft 24 extending into the forward housing 156. Bearings 166 for supporting the output shaft 24 may be located in the forward shaft chamber 164. An annular seal groove 168 may be defined by a radially outward portion of the forward housing 156 for receiving a seal ring (not shown) for sealing between the forward housing 156 and the center housing 26.

The forward housing 156 may also include N+1 motor bolt holes 170, such as the illustrated seven motor bolt holes 170, extending axially through a radially outward extent of the forward housing 156 located radially outward of the mating surface 160. The motor bolts 90 may extend axially rearwardly through the motor bolt holes 170 of the forward housing 156, through the inner recesses 86 of the center housing 26, through the motor bolt holes 95 of the commutator assembly 96, and into the motor bolt holes 152 of the rear housing 100. In this manner, the motor forward, intermediate, and rear sections 20, 16, 12 may be thereby coupled together. Also in this manner, the forward housing 156, the center housing 26, portions of the commutator assembly 96, and the rear housing 100 may collectively be coupled together and referred to as a housing.

Further included in the forward housing 156 may be an axially extending outwardly open drain passage 172, extending radially inward to the center bore 162. A drain plug, such as a drain bolt 174, may be received in, such as threaded into, the drain passage 172 for sealing the drain passage 172. An auxiliary passage 176 may extend axially through the forward housing 156 for fluidly connecting the drain passage 172 to the outer chamber 92 (FIG. 5) of the intermediate housing section 16.

Accordingly, selective alignment of each of the auxiliary apertures 122 (FIG. 8) with one another and with the outlet portion 154 (FIG. 12) may allow for fluid communication between the outlet port 132 (FIG. 12) and chambers surrounding the output shaft 24, such as the rear shaft chamber 142 (FIG. 12) and/or the forward shaft chamber 164. In this way, selective alignment of the auxiliary apertures 122 in respect to the outlet portion 154 may allow for the hydraulic motor 10 to function as a two-chamber motor, with two pressure zones, or a three-chamber motor, with three pressure zones.

In a two-chamber hydraulic motor, the auxiliary apertures 122 may be aligned with the outlet portion 154. Low pressure fluid may flow between the outlet port 132, the annular outlet passage 136 (FIG. 12), the outlet portion 154, the aligned auxiliary apertures 122, the outer chamber 92, the auxiliary passage 176, the forward shaft chamber 164, an area between the rotor splines 52 and shaft splines 55, and the rear shaft chamber 142. Pressure may be equalized between the low pressure volume chambers 72, the shaft chambers 142, 164, and the outer chamber 92. Thus the shaft chambers 142, 164 and the outer chamber 92 all may be at low pressure.

In a three-chamber hydraulic motor, the auxiliary apertures 122 may not be aligned with each other. Alternatively, if the auxiliary apertures 122 are aligned with one another, the apertures 122 may not be aligned with the outlet portion 154. Thus the shaft chambers 142, 164 and the outer chamber 92 may be pressurized at a pressure different than the high pressure fluid entering the inlet port 130 and the low pressure fluid exiting the outlet port 132. The drain bolt 174 may be removed and a drain conduit (not shown) may be attached to the forward housing 156 for fluidly connecting the shaft chambers 142, 164 to a hydraulic system reservoir (not shown). In this way, excess hydraulic fluid that has leaked into the shaft chambers 142, 164 and the outer chamber 92 from the volume chambers 72 may be returned to the system reservoir.

Figure 15:
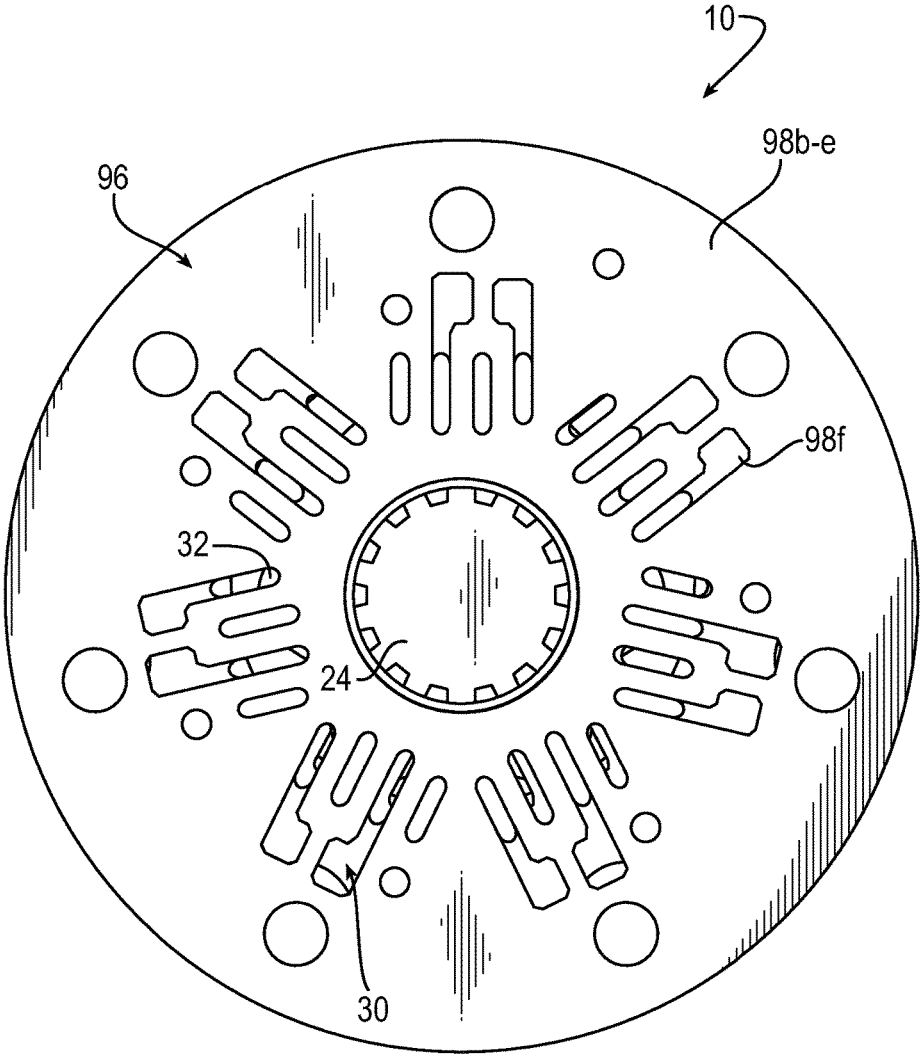
FIG. 15 is a rear view of the commutator assembly and revolving group.
Figure 16:
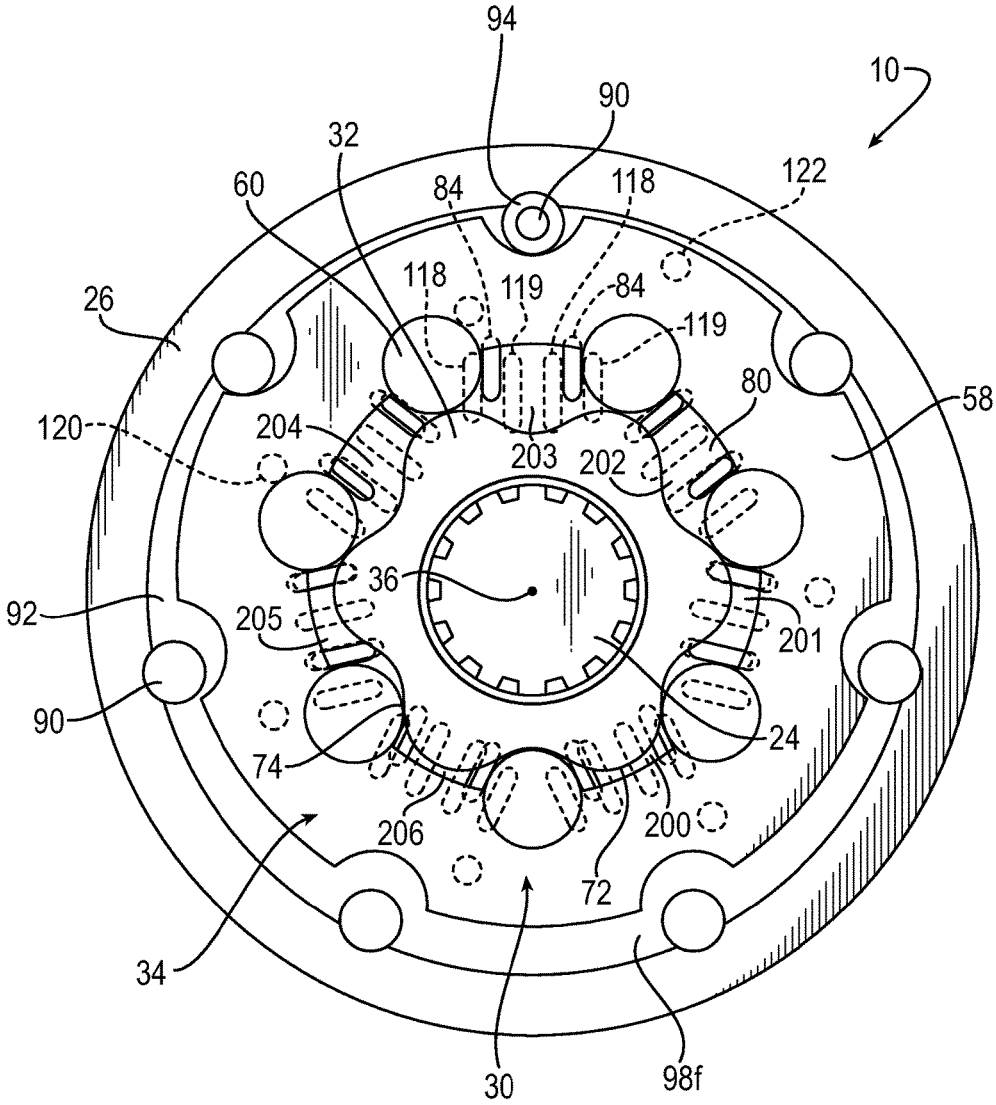
FIG. 16 is a front view of the revolving group showing hidden fluid ports and fluid windows in broken lines.

Referring to FIGS. 14-16, the hydraulic circuit and operation of the hydraulic motor 10 is illustrated. When high pressure pressurized hydraulic fluid flows into the motor 10, through the inlet port 130, the resistance of an external torsional load on the motor 10 may begin to build differential pressure between volume chambers 72, thereby causing low pressure fluid to flow out of the motor 10 through the outlet port 132. The differential pressure between the volume chambers 72 may cause the inner rotor 32 to rotate in the desired direction due to flow through the commutator assembly 96 and through the orbiting valve plate 80, together serving as a timing valve means for the hydraulic motor 10. As such, the force driving the revolving motion of the revolving group 30 may be due to a timed change in pressure of hydraulic fluid in the volume chambers 72.

The timing may be at least partially accomplished by the valve plate 80 that orbits integral with the orbiting ring 58, with the rigidity of the revolving group 30 enabling the inner rotor 32 and orbiting ring 58 to revolve in relation to one another. As the inner rotor 32 rotates in a first direction, the orbiter 34 may be caused to orbit in an opposite direction. Some of the chambers 72 may be caused to selectively expand while the other of the chambers 72 are caused to selectively contract, providing a continuous pressure differential between sealed volume chambers 72.

More specifically, high pressure fluid may be delivered, such as injected, into the inlet port 130, and subsequently into the high pressure fluid ports 102 extending through the commutator assembly 96. The high pressure fluid may be exposed to different volume chambers 72 once the chambers 72 are exposed to the high pressure fluid ports 102 via orbiting of the valve windows 84. Rotation of the inner rotor 32 in a first direction may be sustained as the orbiter 34 is orbited in the opposite direction about the fixed longitudinal axis 36. The orbiter 34 may be constrained from rotating via the motor bolts 90, thereby causing the volume chambers 72 to expand and contract. As the chambers 72 containing high pressure fluid expand and then reach maximum expansion, the high pressure fluid may lose pressure, becoming low pressure fluid. The low pressure fluid may be withdrawn from the volume chambers 72 that have reached their maximum expansion and have begun to contract. Particularly, the low pressure fluid may be withdrawn or exhausted out the outlet port 132 once the volume chambers 72 with low pressure fluid are exposed to the low pressure fluid ports 104 via continued orbiting of the valve windows 84. As a result, the continued rotation of the inner rotor 32 may drive the rotation of the output shaft 24 interengaged with the inner rotor 32.

For example, as shown in FIG. 16, seven volume chambers 72 are defined by the revolving group 30 of FIG. 1, and are separately referenced at 200-206, in counter-clockwise order starting at the chamber 200 located approximately at a five-o'clock location. As viewed at the instant in revolution of the revolving group 30 illustrated in FIG. 16, the inner rotor 32 is rotating in a counter-clockwise direction about the center axis 36, while the orbiting ring 58 is orbiting in a clockwise direction about the center axis 36. The chambers 200, 201, 202 are expanding due to high pressure fluid being injected into these volume chambers 72. Chamber 202 has the greatest amount of high pressure fluid being injected therein due to the substantial alignment of the fluid windows 84 of the valve plate 80 with the high pressure apertures 118 of the forward commutator plate 98*f*. Chamber 203 is fully expanded and substantially no fluid is flowing into or out of this chamber. Chambers 204, 205, 206 are contracting as low pressure fluid is being exhausted out of these chambers 72. Chamber 204 has the greatest amount of low pressure fluid being exhausted therefrom due to the substantial alignment of the fluid windows 84 with the low pressure apertures 119.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A hydraulic motor comprising:

a motor housing having a fluid inlet and a fluid outlet;

an output shaft mounted within the motor housing for rotation about a fixed longitudinal axis; and a revolving group for revolving in respect to the fixed longitudinal axis, the revolving group including:

an inner rotor mounted on the output shaft, the inner rotor having a plurality of lobes circumferentially spaced along an outer periphery of the inner rotor;

an orbiting ring surrounding the inner rotor, the orbiting ring having a plurality of inner recesses circumferentially spaced along an inner periphery of the orbiting ring;

a plurality of roller vanes disposed between the inner rotor and the orbiting ring, the roller vanes being received in the inner recesses for common orbiting with the orbiting ring about the fixed longitudinal axis, wherein the orbiting ring and roller vanes orbit about the inner rotor and in respect to the fixed longitudinal axis; and a valve plate integral with the orbiting ring, the valve plate having a plurality of fluid windows for enabling fluid communication between the fluid inlet and outlet and the revolving group.

2. The hydraulic motor according to claim 1, further comprising a commutator assembly coupled to the motor housing, the commutator assembly including a plurality of commutator plates each having a plurality of apertures forming inlet and outlet ports for enabling fluid communication between the fluid inlet and outlet and the valve plate.

3. The hydraulic motor according to claim 1, wherein the lobes and the roller vanes interengage to define a plurality of expanding and contracting volume chambers, and wherein rotation of the inner rotor causes the volume chambers to change volume.

4. The hydraulic motor according to claim 1, further comprising:

a commutator plate mounted to the housing, the commutator plate in fluid communication with the fluid inlet and outlet; and a valve plate configured to orbit with the orbiting ring, wherein the valve plate includes fluid windows that align with the inlet and outlet ports in the commutator plate to cause the volume chambers to expand and contract.

5. The hydraulic motor according to claim 1, wherein the orbiting ring has a plurality of outer recesses circumferentially spaced along an outer periphery of the orbiting ring, and wherein each outer recess interengages with a radially-extending protrusion spaced circumferentially about an inner periphery of the motor housing to constrain the orbiting ring from rotating.

6. The hydraulic motor of claim 5, wherein the radially-extending protrusion is a motor bolt extending into the motor housing and located between an inner periphery of the motor housing and the outer periphery of the orbiting ring.

7. The hydraulic motor according to claim 1, wherein the inner periphery of the orbiting ring is cylindrical.

8. The hydraulic motor according to claim 1, wherein the roller vanes are cylindrical, and wherein the outer periphery of the inner rotor is trochoidal for maintaining contact with the cylindrical roller vanes.

9. The hydraulic motor according to claim 1, wherein the inlet and outlet are disposed at the same axial side of the revolving group.

10. The hydraulic motor according to claim 1, wherein each window of the plurality of fluid windows extends fully axially through the valve plate along the fixed longitudinal axis.

11. A hydraulic motor comprising:

a motor housing; and a revolving group for revolving in respect to the motor housing, the revolving group including:

an inner rotor for rotating in respect to the motor housing, the inner rotor having a plurality of lobes circumferentially spaced along an outer periphery of the inner rotor; and an orbiter surrounding the inner rotor, the orbiter having a plurality of radially-extending rounded portions circumferentially spaced along an inner periphery of the orbiter, and the orbiter having a plurality of radially outwardly extending fluid windows, wherein the orbiter orbits around the inner rotor in respect to the motor housing, and the lobes glide against the radially-extending rounded portions to define a plurality of volume chambers, wherein the orbiter has fixed for movement therewith the plurality of radially outwardly extending fluid windows aligned with the plurality of volume chambers, and wherein spacing between the plurality of radially outwardly extending fluid windows and the plurality of radially-extending rounded portions remains constant during rotation of the inner rotor and orbiting of the orbiter, thereby preventing direct fluid communication between the volume chambers.

12. The hydraulic motor according to claim 11, further comprising a valve plate mounted to the orbiter and having the plurality of fluid windows, wherein a longitudinal center axis of each of the valve plate and the orbiter follow the same path in orbiting about a fixed longitudinal center axis of the inner rotor, thereby preventing alignment of each fluid window with more than one volume chamber at a time.

13. The hydraulic motor according to claim 11, wherein the lobes and the radially-extending rounded portions glide against one another and interengage at shifting contact points between the lobes and the radially-extending rounded portions, and wherein no shifting contact point passes over a fluid window in the valve plate.

14. The hydraulic motor according to claim 11, wherein the orbiter includes:

an orbiting ring surrounding the inner rotor, the orbiting ring having a plurality of inner recesses circumferentially spaced along an inner periphery of the orbiting ring; and a plurality of roller vanes disposed between the inner rotor and the orbiting ring, the roller vanes being received in the inner recesses and forming the radially-extending rounded portions of the orbiter.

15. The hydraulic motor according to claim 11, further comprising a plurality of motor bolts located between an inner periphery of the motor housing and an outer periphery of the orbiter, wherein the motor bolts constrain the orbiter from rotating.

16. The hydraulic motor according to claim 11, wherein the radially-extending rounded portions circumferentially spaced along the inner periphery of the orbiter are semi-cylindrical portions, and wherein the inner rotor has a trochoidal outer periphery for remaining in continuous contact with the semi-cylindrical portions of the orbiter.

17. The hydraulic motor according to claim 11, wherein each window of the plurality of radially outwardly extending fluid windows communicates with each of an inlet and an outlet of the motor housing, and wherein the inlet and outlet are disposed at the same axial side of the orbiter.

18. The hydraulic motor according to claim 11, wherein each window of the plurality of radially outwardly extending fluid windows in combination with a respective volume chamber defines a respective linear passage fully axially through the orbiter along a fixed longitudinal center axis of the motor housing about which the inner rotor rotates.

19. A method of utilizing pressurized fluid to produce rotary motion comprising the steps of:

injecting fluid into a motor housing and directing the fluid through a plurality of fluid ports in a commutator assembly coupled to the motor housing;

selectively transmitting the fluid through fluid windows of a revolving valve, the revolving valve further including N rotor lobes on an inner rotor for rotating about a fixed longitudinal axis and for interengaging with N+1 radially-extending rounded portions of an orbiter surrounding the inner rotor to form N+1 sealed variable volume chambers therebetween, wherein the fluid windows orbit about the fixed longitudinal axis;

selectively expanding some of the sealed volume chambers by providing a pressure differential between the sealed volume chambers to produce a rotary motion of the inner rotor, thereby driving an output shaft interengaged with the rotor;

withdrawing through the fluid windows of the revolving valve the fluid from the sealed volume chambers that have reached their maximum expansion; and exhausting the fluid from the motor housing.

* * * * *